United States Patent [19]

Grable et al.

[11] 4,103,269

[45] Jul. 25, 1978

[54] THERMOSTAT AND TIP SWITCH ASSEMBLY

[75] Inventors: Jack W. Grable; Steven A. Willeke, both of Mansfield, Ohio

[73] Assignee: Essex Group, Inc., Fort Wayne, Ind.

[21] Appl. No.: 761,505

[22] Filed: Jan. 21, 1977

[51] Int. Cl.[2] ..... H01H 71/16

[52] U.S. Cl. ..... 337/67; 337/8.5; 337/337

[58] Field of Search ..... 337/67, 68, 85, 87, 337/347, 349, 360, 361, 362, 363, 374

[56] References Cited

U.S. PATENT DOCUMENTS

| | | | |
|---|---|---|---|
| 3,451,029 | 6/1969 | Levinn et al. | 337/349 |
| 3,452,312 | 6/1969 | Bauer | 337/349 X |
| 3,913,048 | 10/1975 | Mertler | 337/67 |

*Primary Examiner*—George Harris
*Attorney, Agent, or Firm*—Lawrence E. Freiburger; Robert D. Sommer

[57] ABSTRACT

A combination thermostat tip switch assembly in which a bimetal member carrying a double-faced contact is mounted in a stack assembly between two resilient contact leaves each carrying an electrical contact adapted to mate with the double-faced contact. The stack is mounted on a rigid base member which supports an adjusting mechanism adapted to cooperate with one of the contact leaves so as to provide an adjustment of the operating temperature of the thermostat. A position sensitive mechanism in the form of a pendulum is mounted on one of the contact leaves and cooperates with the other contact leaf to move the two away from one another.

6 Claims, 7 Drawing Figures

THERMOSTAT AND TIP SWITCH ASSEMBLY

BACKGROUND OF THE INVENTION

There are many different types of combination thermostat tip switches known in the prior art. One such type is the one disclosed in U.S. Pat. No. 3,201,548 which is assigned to the same assignee as the present invention. Generally, this type of thermostat tip switch assembly includes a pair of contact leaves mounted on a stack assembly and a thermostatic bimetal leaf mounted on the stack which was adapted to move a pair of contacts on the leaves out of engagement with one another. A position sensitive pendulum is mounted on one of the contact leaves and acts to operate the same two contacts. The problem with this type of combination thermostat-tip switch is that the contacts occasionally weld together which renders the pendulum ineffective to disengage the contacts regardless of the position of the switch.

By increasing the number of contact interfaces through which electrical current must travel, the likelihood that the tip switch portion of a combination thermostat tip-switch will fail to perform its intended function is decreased because the probability of all the contact interfaces welding at the same time is decreased. Thus, the combination thermostat tip switch shown in U.S. Pat. No. 3,964,004 is increased in reliability insofar as the tip switch is concerned.

However, while the combination thermostat tip switch disclosed in U.S. Pat. No. 3,964,004 provides a greater degree of safety over prior art designs, it does so with a substantial increase in cost and size. Thus, it would be desirable to provide the same degree of safety in a combination thermostat tip switch as the device disclosed in U.S. Pat. No. 3,964,004 but reduced in cost and size.

SUMMARY OF THE INVENTION

Thus it is an object of the present invention to provide a combination thermostat tip switch assembly which has the same advantages as the one disclosed in U.S. Pat. No. 3,964,004 but which accomplishes these advantages with a cost savings and an overall reduction in size.

This object as well as others which will become apparent as the description of the invention proceeds is accomplished by the combination thermostat switch of the invention. Essentially, the combination thermostat tip switch of the invention accomplishes this object by eliminating one of the contact leaves and connecting link in the prior art device. Thus, in summary the combination thermostat tip switch of the invention includes two contact leaves and a bimetal leaf mounted between them in a stack assembly. The bimetal leaf carries a double faced electrical contact which cooperates with contacts on the two contact leaves to normally complete the circuit from one contact leaf to the other. Upon heating the bimetal leaf moves to break the contact between its double faced electrical contact and the contact on the second contact leaf. A position sensitive means is mounted on the second contact leaf and cooperates with the first contact leaf to control the distance between the two contact leaves as a function of position. As a result, in certain positions, the two contact leaves are forced apart far enough to prevent current flow through the double faced contact.

BRIEF DESCRIPTION OF THE DRAWINGS

During the course of the detailed description of the invention, reference will be made to the drawings in which.

DESCRIPTION OF THE PREFERRED EMBODIMENT OF THE INVENTION

Figure 1:
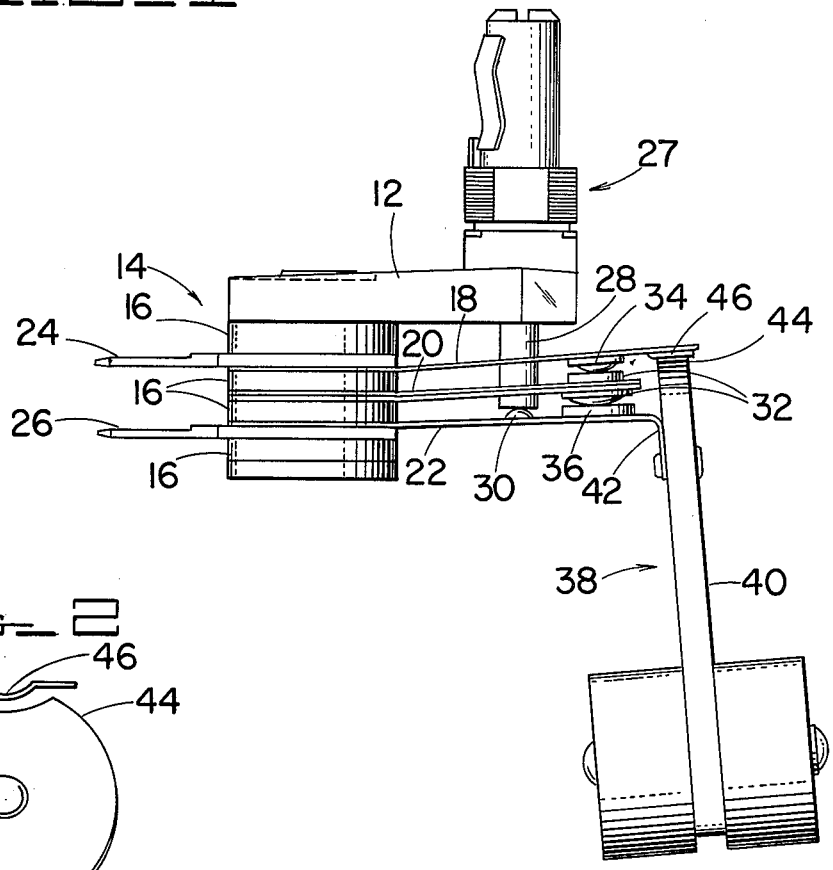
FIG. 1 is a side elevational view of a combination thermostat tip switch assembly in accordance with the present invention.
Figure 2:
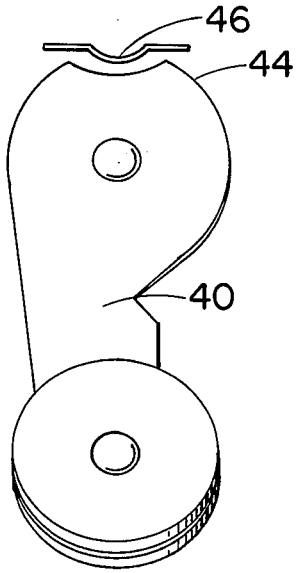
FIG. 2 is a partial front elevational view of a combination thermostat tip switch assembly in accordance with the invention.
Figure 3:
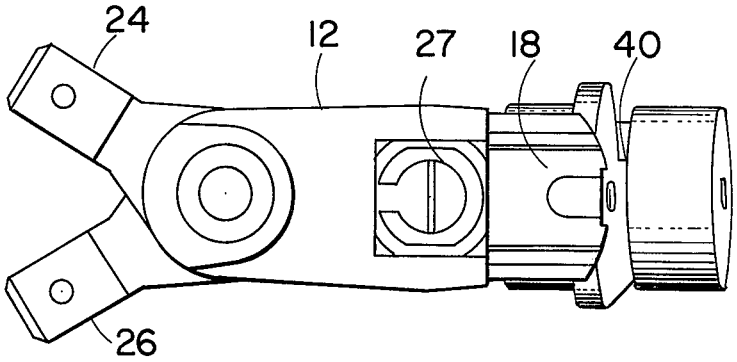
FIG. 3 is a top elevational view of a combination thermostat tip switch assembly in accordance with the present invention.

Referring now to the drawings and, in particular, FIGS. 1–3, the combination thermostat tip switch in accordance with the present invention includes a rigid base member 12 which is secured to a stack assembly 14. The stack assembly includes a plurality of insulators, terminals, contact leaves, a bimetal member and is secured together along with the base member 12 by any suitable means known in the art. The insulators 16 serve to electrically insulate a first contact leaf 18, a bimetal leaf 20 and a second contact leaf 22 from one another. In addition, as is well known in the art, electrical contact is made to contact leaves 18 and 22 by terminal members 24 and 26 respectively which are placed adjacent to the contact leaves in the stack assembly.

A mounting and adjusting mechanism 27 of the type which is well known in the art is utilized. The mounting means may be a threaded stud which is an integral part of base member 12 or a separate member attached to the base member. An insulating stud 28 extends through suitable apertures in contact leaf 18 and bimetal member 20 in such a manner that the end thereof abuts against a dimpled portion 30 on contact leaf 22. Contact leaf 22 is mounted in the stack assembly 14 with an upward bias and, thus, stud 28 serves to vary the distance between base member 12 and contact leaf 22.

Bimetal leaf 20 has a double faced electrical contact 32 mounted on it near its free end which cooperates with an electrical contact 34 mounted on the free end of contact leaf 18 and electrical contact 36 mounted on the free end of contact leaf 22. The contact leaf 18 is biased toward bimetal leaf 20 in such a manner that contact 34 normally is in contact with contact 32. Thus, contacts 36 and 32 form a pair of thermostatic contacts which open when the bimetal leaf 20 warps upwardly. Of course, it will be appreciatd by those skilled in the art that the thermostatic contacts may be made to open upon temperature increase or close upon temperature increase simply by reversing the bimetal.

A position sensitive mechanism generally indicated by reference numeral 38 includes a pendulum member 40 pivotally mounted on the extreme end 42 of contact leaf 22 which is bent generally downwardly as indicated in the drawing. It will be clear to those skilled in the art that other position sensitive mechanism may be employed as well. The upper end of pendulum member 40 forms a camming surface 44 which cooperates with an indent 46 in the end of contact leaf 18 to vary the relative distance between contact leaves 18 and 22 as a function of position.

The operation of the thermostat tip-switch assembly should be clear to those skilled in the art from the above-noted description but, for sake of clarity, its operation will be briefly described. It will be assumed that the thermostat is desired to open on temperature increase. Thus, when the device is cold, contacts 34 and 36 will normally be in engagement with double faced contact 32 to complete the electrical circuit through terminals 24 and 26. As the temperature increases, bimetal leaf 20 will warp upwardly and will eventually break the contact between contact 32 and 36 to break the circuit. Upon cooling, the circuit will close and the device will continue to open and close in this manner. Should the device in which the combination thermostat tip switch assembly is mounted tip over for any reason, the pendulum 40 will pivot forcing contact blades 18 and 22 apart to break the circuit between contacts 34 and 32, and thus terminals 24 and 26.

Figure 4:
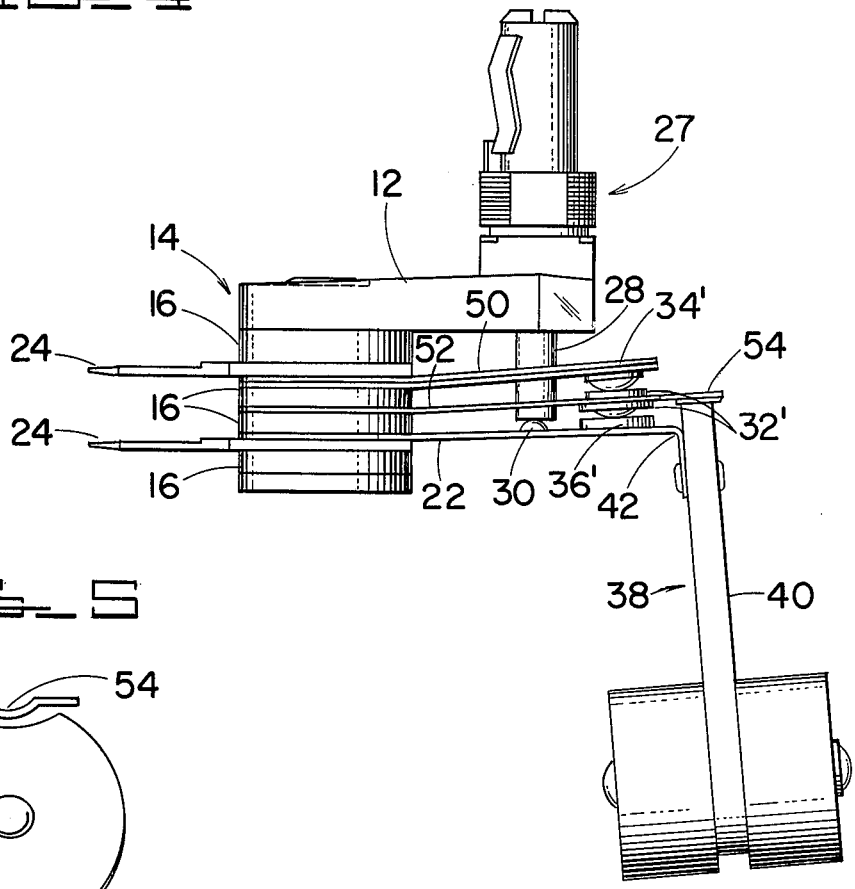
FIGS. 4 and 5 are views similar to FIGS. 1 and 2 of an alternate construction in accordance with the invention.
Figure 5:
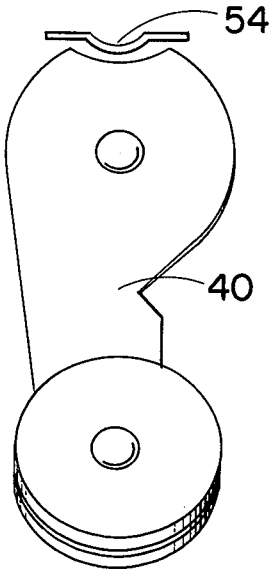

In the alternate embodiments of FIGS. 4 and 5, the same reference numerals have been used to designate the same parts as in the embodiment of FIGS. 1 and 3. Generally speaking, the embodiment of FIGS. 4 and 5 differs from the embodiment of FIGS. 1–3 in that the upper contact leaf and bimetal leaf are reversed. Thus, the thermostat and tip switch assembly may include a bimetal leaf 50 which is mounted in the stack in electrical contact with terminal 24. The lower contact leaf 22 is mounted on the stack in the same position as the previous embodiment and a middle contact leaf 52 is mounted upon the stack with double contact 32' on its end such that it cooperates with contacts 34' and 36'. The pendulum 40 is still mounted on lower contact leaf 22, but it cooperates with an extension 54 on contact leaf 52 to control the relative distance between contact leaves 22 and 52. Thus, it will be appreciated that in the embodiment of FIGS. 4 and 5 contacts 32' and 36' form a pair of position sensitive contacts and contacts 34' and 32' for a pair of thermally sensitive contacts.

Figure 6:
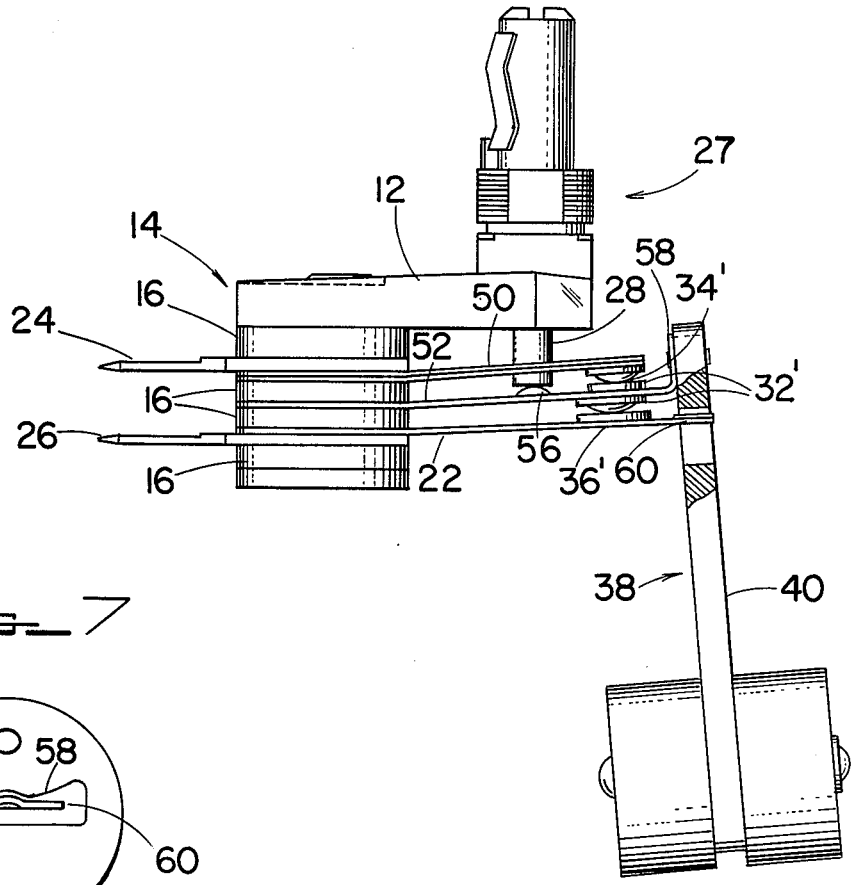
FIGS. 6 and 7 are views similar to FIGS. 1 and 2 of a second alternate construction in accordance with the invention.
Figure 7:
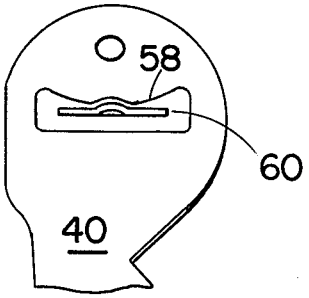

Referring now to FIGS. 6 and 7, a second alternate embodiment of the invention is disclosed. Again, the same reference numerals have been employed to designate the same parts. The embodiment of FIGS. 6 and 7 operates essentially in the same manner as the embodiment of FIGS. 4 and 5, the difference between the two being in the pendulum construction and in the adjustment mechanism. As in the embodiment of FIGS. 4 and 5, the upper leaf 50 is the bimetal blade and the middle and lower leaves 52 and 22 are spring blades. Adjustment stud 28 cooperates with a dimple 56 to allow for manual adjustment of the relative distance between the contact leaf 52 and base member 12. The end 58 of contact leaf 52 is bent upwardly and the pendulum member 40 is pivoted thereon. The inner portion of pendulum 40 is cut out to form a cam follower 58 which cooperates with an extension 60 of contact leaf 22 to vary the distance between contact leaves 22 and 52 as a function of position. It will thus be seen that, in the embodiment of FIGS. 6 and 7, the thermostatic contacts are comprised of contacts 32' and 34' and the position sensitive contacts are comprised of contacts 32' and 36'.

It will be appreciated by those skilled in the art that the above-described thermostat tip switch assembly is less costly than the prior art device disclosed in U.S. Pat. No. 3,964,004, but yet offers the same advantages. Furthermore, inasmuch as the assembly of the invention eliminates one contact leaf, it is smaller and offers a size advantage over the prior art device.

Of course obvious modifications will occur to those skilled in the art. It is intended that the invention as defined in the claims include these obvious modifications.

What is claimed is:

1. A combination thermostat tip switch assembly, comprising:

a rigid base member;

a stack mounted upon said base member;

three elongated resilient leaves mounted co-extensively with one another upon said stack;

one of said leaves being thermally responsive;

means for making electrical contact to the outer leaves;

a thermally responsive contact set comprising an electrical contact mounted upon said thermally responsive leaf and a cooperating electrical contact mounted upon an adjacent leaf;

a position sensitive contact set comprising an electrical contact mounted upon the third leaf and a cooperating electrical contact mounted upon an adjacent leaf;

said thermally responsive contact set and said position sensitive contact set together being capable of completing the circuit between said outer leaves; and position sensitive means for operating said position sensitive contact set.

2. The combination thermostat tip switch assembly as claimed in claim 1, wherein said position sensitive means comprises a pendulum member mounted upon one of said leaves and cooperating with another leaf to vary the distance between them as a function of position.

3. The combination thermostat tip switch assembly claimed in claim 1, further comprising adjusting means for adjusting the operating point of said thermally responsive contact set.

4. The combination thermostat tip switch assembly as claimed in claim 1, wherein said thermally responsive leaf is the middle leaf.

5. The combination thermostat tip switch assembly as claimed in claim 1 wherein said thermally responsive leaf is the leaf nearest the base member.

6. The combination thermostat tip switch assembly as claimed in claim 1, wherein said thermally responsive contact set and said position sensitive contact set comprise a double faced electrical contact on the middle leaf and cooperating contacts on the outer leaves.

* * * * *